United States Patent [19]

Yamada

[11] Patent Number: 4,934,746

[45] Date of Patent: Jun. 19, 1990

[54] AUTOMOTIVE DOOR LOCKING APPARATUS

[75] Inventor: Shinjiro Yamada, Utsunomiya, Japan

[73] Assignee: Mitsui Kinzoku Kogyo Kabushiki Kaisha, Tokyo, Japan

[21] Appl. No.: 329,604

[22] Filed: Mar. 28, 1989

[30] Foreign Application Priority Data

Mar. 28, 1988 [JP] Japan ..... 63-73840

[51] Int. Cl.[5] ..... E05C 3/26

[52] U.S. Cl. ..... 292/201; 292/DIG. 26

[58] Field of Search ..... 292/201, 216, 280, DIG. 26, 292/DIG. 27

[56] References Cited

U.S. PATENT DOCUMENTS

| | | | |
|---|---|---|---|
| 3,844,596 | 10/1974 | Torii et al. | 292/216 |
| 4,005,887 | 2/1977 | Ithura | 292/DIG. 26 X |
| 4,252,351 | 2/1981 | Yoshiro et al. | 292/201 X |
| 4,691,949 | 9/1987 | Granty et al. | 292/DIG. 26 X |
| 4,793,640 | 12/1988 | Stewart, Sr. | 292/201 |

*Primary Examiner*—Richard E. Moore

*Attorney, Agent, or Firm*—Browdy & Neimark

[57] ABSTRACT

In an automotive door locking apparatus according to this invention in which the lock lever is switched between the locked position and the unlocked position by a motor-operated actuator, when with the lock lever in the locked position the inner lever is manually operated, the rotating member is activated to disengage the ratchet from the latch while at the same time the lock lever and the actuator are returned to the unlocked position.

2 Claims, 7 Drawing Sheets

AUTOMOTIVE DOOR LOCKING APPARATUS

BACKGROUND OF THE INVENTION

This invention relates to an automotive door locking apparatus.

A conventional automotive door locking apparatus, as disclosed in the Japanese Utility Model Application Laid-Open No. 154994/1979, comprises: a latch for engaging with a striker secured to the car body; a ratchet for preventing the latch from reversing; a rotating member for disengaging the ratchet from the latch; an open lever connected to an outer open handle of the door; a lock lever switched between two positions, i.e., an unlocked state in which the open lever can engage with the rotating member and a locked state in which they cannot engage with each other; and an inner lever connected to an inner open handle of the door; whereby the operation of the inner lever activates the rotating member regardless of whether the lock lever is in the locked or unlocked state, and moves the lock lever, when it is in the locked state, to the unlocked position.

In the above known example, the lock lever is switched manually.

SUMMARY OF THE INVENTION

In a door locking apparatus of this invention in which the lock lever is switched between a locked position and an unlocked position by an actuator using an electric motor, the manual operation of the inner lever, when the lock lever is in the locked state, activates the rotating member and at the same time returns both the lock lever and the actuator to the unlocked position.

DETAILED DESCRIPTION OF THE PREFERRED EMBODIMENT

Figure 1:
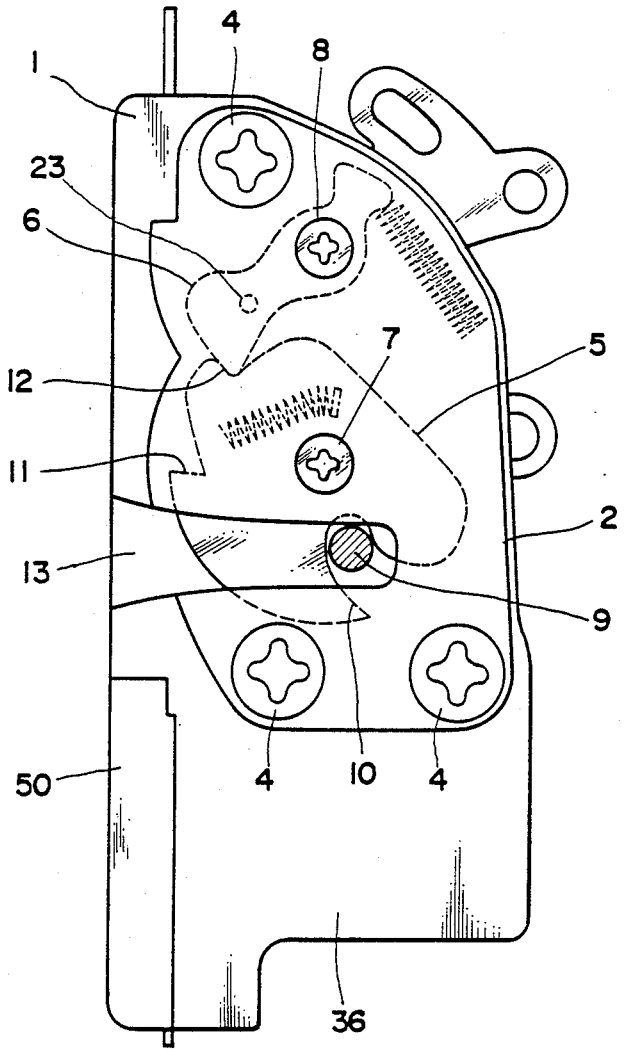
FIG. 1 is a front view of a door locking apparatus of this invention.
Figure 2:
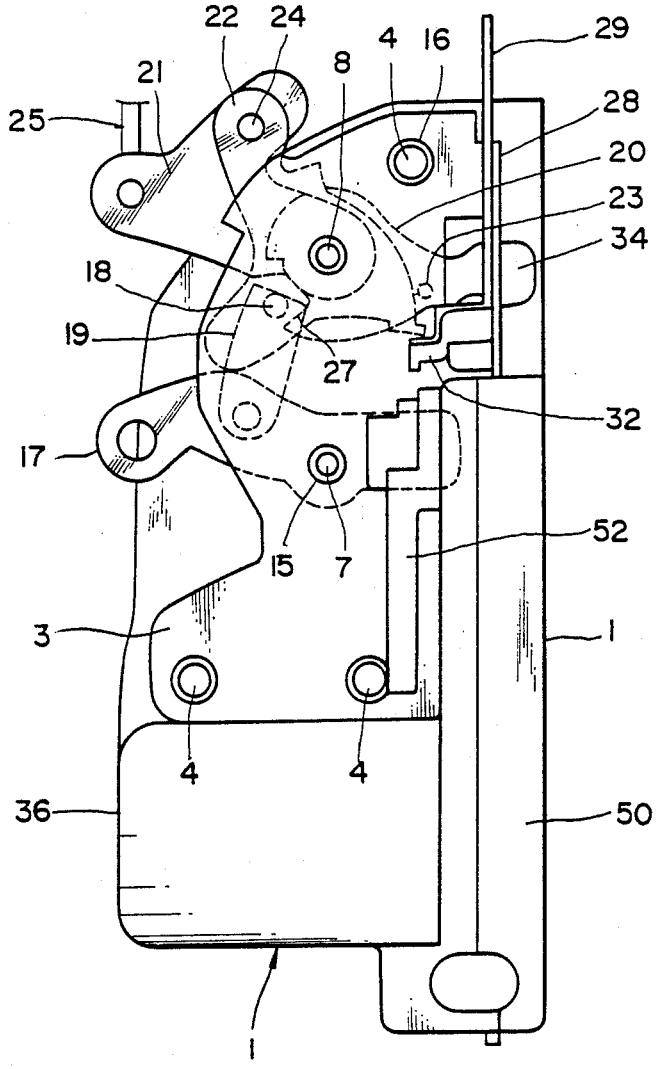
FIG. 2 is a rear view of the door locking apparatus.

One embodiment of this invention will be described by referring to the attached drawings. Reference numeral 1 represents a body of the lock formed of synthetic resin. The body 1 is attached with a metal cover plate 2 on the front side and, at the back, with a metal back plate 3. On the front side of the body 1 is formed a recess in which a latch 5 and a ratchet 6 are rotatably mounted on a shaft 7 and a shaft 8, respectively. Denoted 9 is a striker, 10 an engagement groove formed in the latch 5 with which the striker 9 engages, 11 a half-latch groove, 12 a full-latch groove, and 13 an advancement groove for the striker 9. Between the synthetic resin body 1 and the back plate 3 is formed a space 14 to accommodate the operation levers.

The rear ends of the shafts 7, 8 are passed through the synthetic resin body 1 and screwed into threaded cylinders 15, 16 formed in the backplate 3. A lock lever 17 is rotatably mounted on the shaft 7 in the outer circumference of the space 14. On the lock lever 17 is rotatably mounted a rotating piece 19 with an engagement projection 18.

Mounted on the shaft 8 in the outer circumference of the space 14 are a rotating member 20, a connecting plate 21 and an open lever 22 in that order. The rotating member 20 turns the ratchet 6 through a pin 23 that couples the ratchet 6 and the rotating member 20. The connecting plate 21 and the open lever 22 are connected together so that their relative mounting position can be adjusted by an adjust screw 24. The connecting plate 21 is connected with a rod 25 of the outer open handle of the door. The open lever 22 is formed with a slot 26 in which the engagement projection 18 of the rotating piece 19 is inserted.

Figure 10:
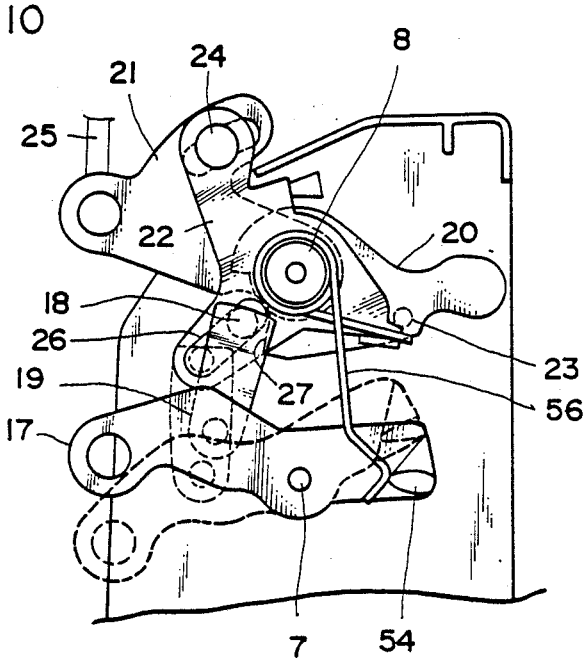
FIG. 10 is a front view of the lever group.

In FIG. 10, the lock lever 17 is shown in the unlocked position by a solid line. In this state, when the outer open handle is operated to turn the open lever 22 counterclockwise, the engagement projection 18 in the slot 26 moves to engage with an engagement step 27 of the rotating member 20, turning the rotating member 20 counterclockwise 9. This in turn rotates the ratchet 6. The dotted line indicates the lock lever 17 in the locked position, in which any rotation of the open lever 22 does not result in the engagement projection 18 engaging with the engagement step 27, so that the ratchet 6 does not rotate.

Denoted 28 is a riser piece of the back plate 3, on which an inner lever 29 is rotatably mounted. The inner lever 29 has a first projection 31, a second projection 32 and a third projection 30. The third projection 30 is connected with a rod 33 of the inner open handle. The front end 34 of the rotating member 20 is located on the locus of movement of the first projection 31.

Figure 3:
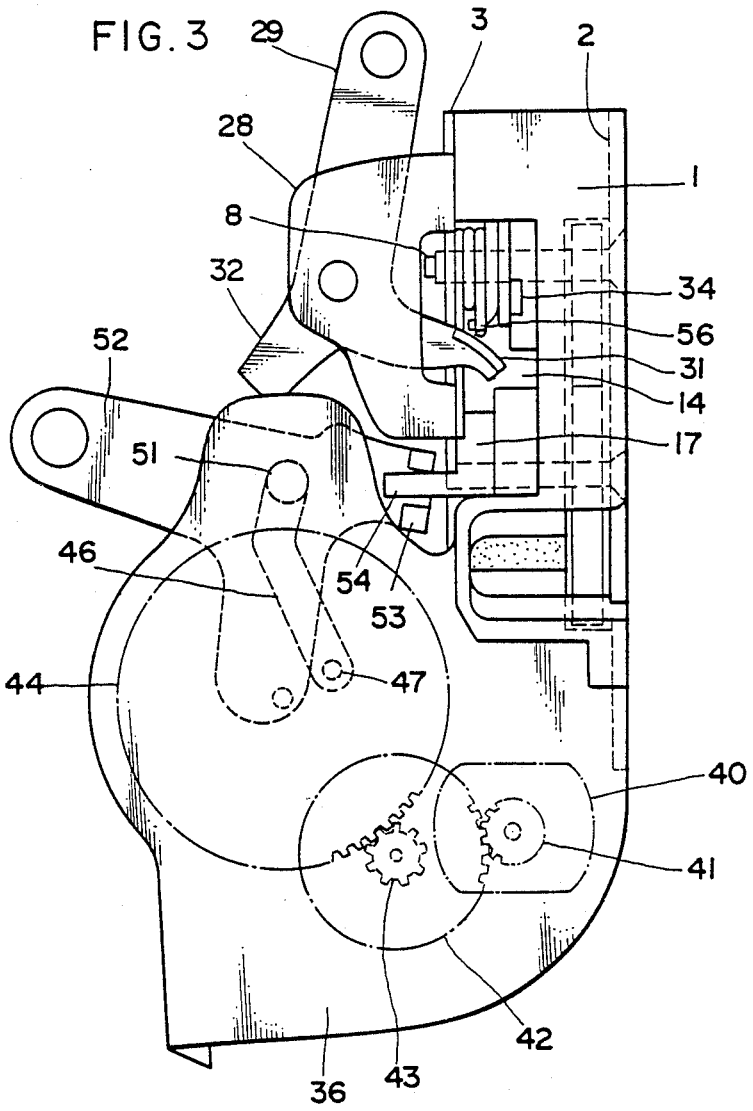
FIG. 3 is a left-hand side view of the door locking apparatus.
Figure 4:
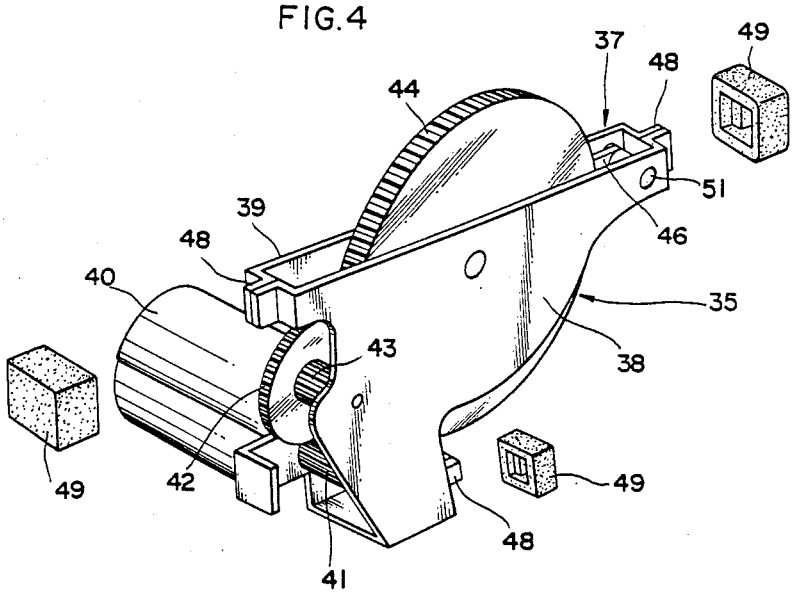
FIG. 4 is a perspective view of an actuator.
Figure 5:
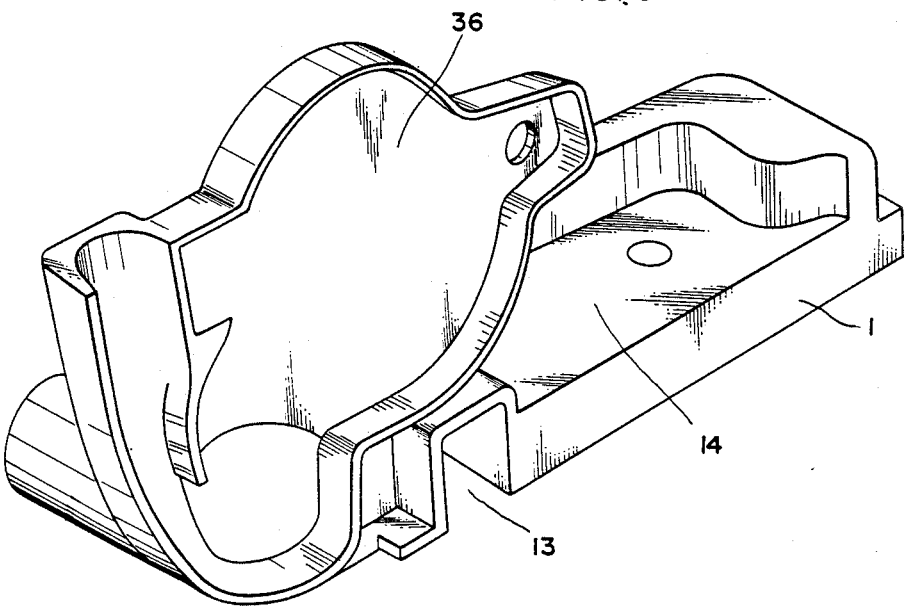
FIG. 5 is a perspective view of a synthetic resin body with its cover removed.

When the inner lever 29 is turned counterclockwise in FIG. 3, the first projection 31 engages with the front end 34 of the rotating member 20, releasing the ratchet 6. Thus, even when the lock lever 17 is in the locked position (indicated by the dotted line in FIG. 10), the door can be opened by operating the inner open handle.

At the lower part of the synthetic resin body 1, an actuator accommodating portion 36 is integrally formed to accommodate the actuator 35. Designated 37 is a frame consisting of a front metal plate 38 and a rear metal plate 39. A motor 40 is rigidly mounted on the rear metal plate 39. A gear 41 of the motor 40 is in mesh with an intermediate gear 42 which is rotatably supported on the frame 37. A small gear 43 formed integral with the intermediate gear 42 is in mesh with a cam gear 44. The cam gear 44 is formed with a cam groove 45 with which a projection 47 of an operating rod 46 is engaged. The frame 37 is covered at its junction 48 with rubber caps 49, by which the actuator 35 is suspended in the actuator accommodating portion 36. Denoted 50 is a cover of the actuator accommodating portion 36.

A rotating shaft 51 of the operating rod 46 is passed through the rear metal plate 39 to project rearwardly, and the projected portion is rigidly attached with a switching lever 52. One end 53 of the switching lever 52 is engaged with a projection 54 formed at the left end of the lock lever 17.

The relationship between the actuator 35 and the lock lever 17 is as follows.

Figure 7:
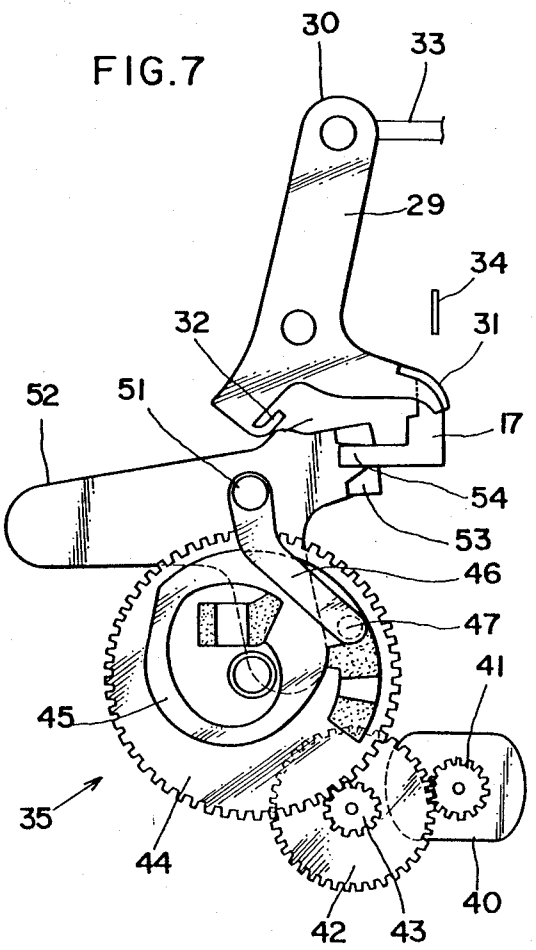
FIG. 7 is a side view showing the actuator and a group of levers in the locked position.
Figure 6:
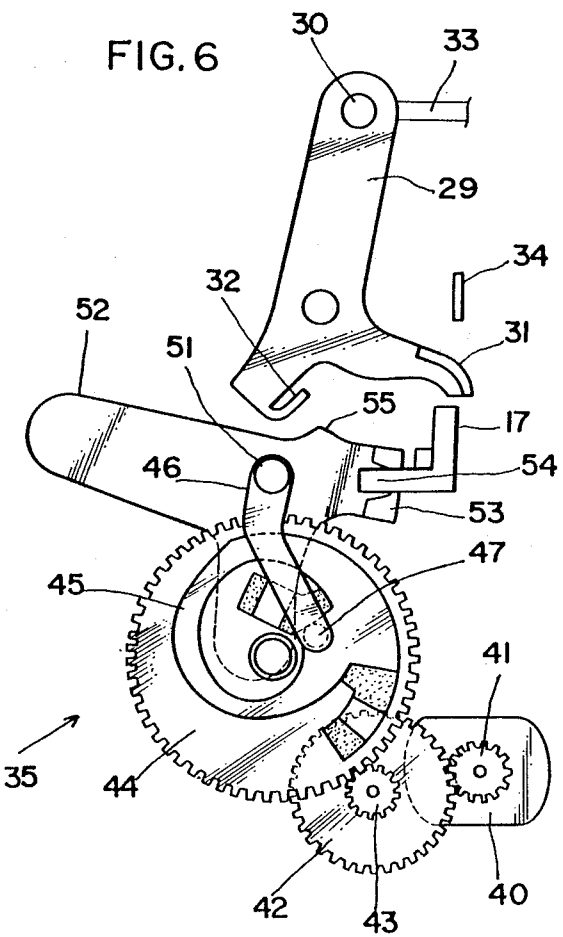
FIG. 6 is a side view showing the actuator and a group of levers in the unlocked position.
Figure 8:
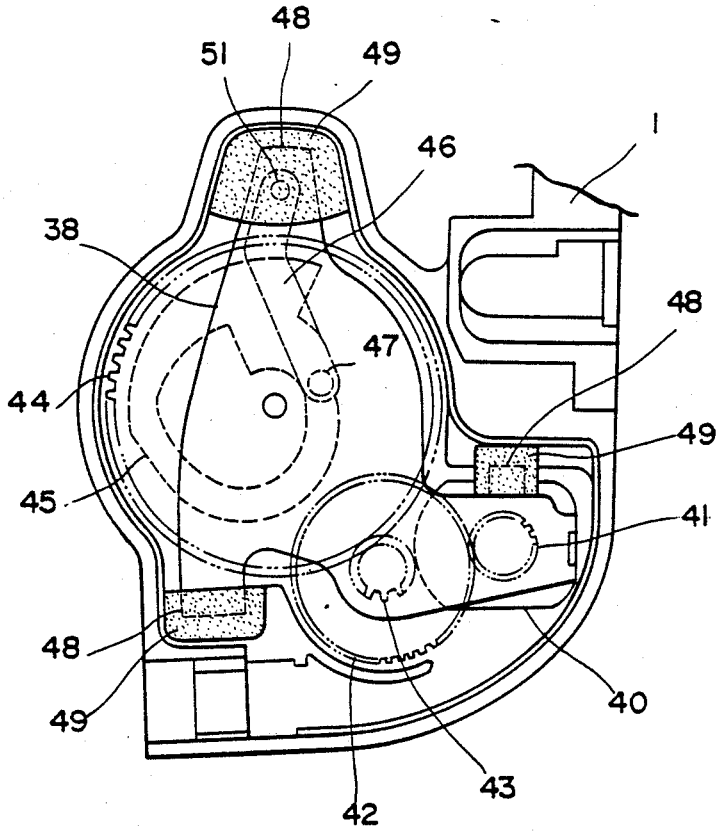
FIG. 8 is a front view of the actuator.
Figure 9:
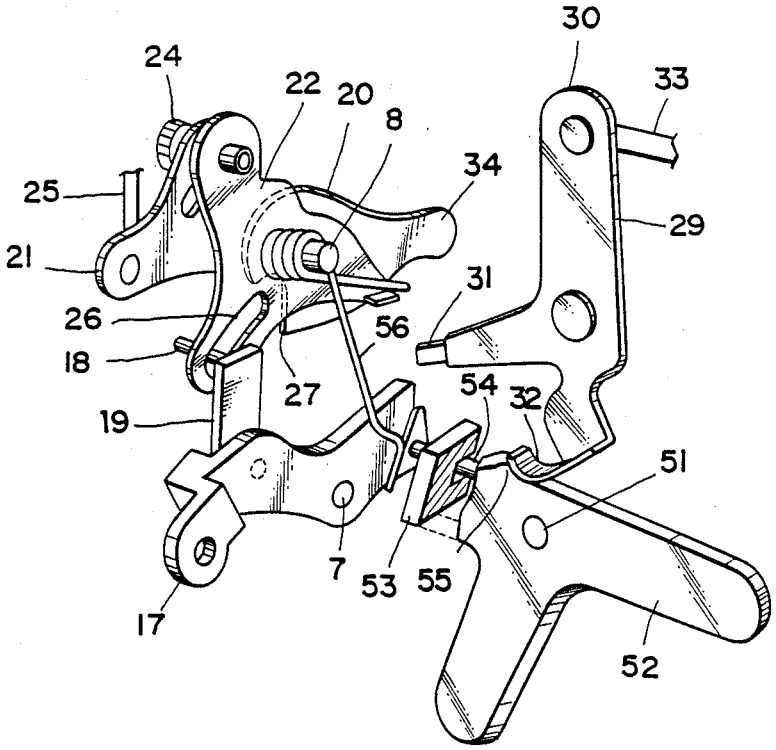
FIG. 9 is a perspective view of the group of levers.

FIG. 6 shows the unlocked state while FIG. 7 shows the locked state. In the state of FIG. 6, when the cam gear 44 is rotated counterclockwise, the operating rod 46 moves along the cam groove 45 and is rotated counterclockwise, assuming the position as shown in FIG. 7. Then the switching lever 52 secured to the rotating shaft 51 of the operating rod 46 also rotates, causing the lock lever 17, through engagement of the end 53 and the projection 54, to rotate counterclockwise in FIG. 10, which in turn moves the engagement projection 18 toward the front end of the slot 26. Now the locking is effected. In the state of FIG. 7, when the cam gear 44 is rotated clockwise, the lock lever moves from the dotted line position to the solid line position in FIG. 10.

The switching lever 52 has a projection 55 projecting toward the inner lever 29. The projection 55, in the locked position of FIG. 7, is located on the locus of the second projection 32 of the inner lever 29. In the unlocked position, it is located so that it will not engage with the second projection 32.

Thus, with the lock lever 17 in the locked position, when the inner open handle is operated to open the door, the inner lever 29 is rotated causing its first projection 31 to engage with the front end 34 of the rotating member 20. This in turn rotates the ratchet 6, disengaging the striker 9 from the latch 5 and at the same time the second projection 32 of the inner lever 29 engages with the projection 55 of the switching lever 52, causing the switching lever 52 to rotate clockwise in FIG. 7, with the result that the lock lever 17 is moved to the unlocked position, shifting the operating rod 46 to the position of FIG. 6. Designated 56 is a spring.

OPERATION

When the door is closed, the striker 9 engages with the engagement groove 10 of the latch 5 regardless of whether the lock lever 17 is in the unlocked or locked position. And the ratchet 6 engages with the full-latch groove 12, thus completing the door closing process.

When, during the process of door closing, the door is to be locked by the actuator 35, the following operation takes place. That is, since the actuator is in the state as shown in FIG. 6, the motor 40 is energized to rotate the cam gear 44 counterclockwise and turn the operating rod 46 counterclockwise along the cam groove 45. This in turn rotates the switching lever 52 counterclockwise through the rotating shaft 51 of the operating lever 46. The resulting engagement between the end 53 of the switching lever 52 and the projection 54 of the lock lever 17 causes the lock lever 17 to rotate counter clockwise in FIG. 10 moving from the solid line position to the dotted line position. Now, the door is locked. In this state, the door cannot be opened by operating the outer open handle because the counterclockwise rotation of the open lever 22 by the operation of the outer open handle does not result in the engagement projection 18 engaging with the engagement step 27 of the rotating member 20.

With the door closed, when the inner open handle is operated, the first projection 31 of the inner lever 29 abuts directly against the end 34 of the rotating member 20, so that the rotating member 20 is rotated counterclockwise in FIG. 10 even if the lock lever 17 is in the locked position. As a result the ratchet 6 coupled to the rotating member 20 through a pin 23 is rotated, disengaging the striker 9 from the latch 5, allowing the door to be opened.

If the lock lever 17 is in the locked position when the inner lever 29 is rotated, the second projection 32 of the inner lever 29 engages with the projection 55 of the switching lever 52 causing the switching lever 52 to rotate clockwise in FIG. 7. The resulting engagement between the end 53 and the projection 54 causes the lock lever 17 to move to the unlocked position. At the same time the projection 47 of the operating rod 46 moves up the cam groove 45, assuming the unlocked state of FIG. 6. Therefore, even when the lock lever 17 is in the locked state, the operation of the inner open handle allows the door opening and the returning of the sill knob and actuator 35 to the unlocked position to be carried out simultaneously.

I claim:

1. An automotive door locking apparatus comprising:

a latch for engaging with a striker rigidly secured to the car body;

a ratchet for preventing reverse rotation of the latch;

a rotating member for disengaging the ratchet from the latch;

an open lever connected to an outer open handle on the door;

a lock lever switched between an unlocked state in which the open lever and the rotating member are engageable with each other, and a locked state in which they are not engageable;

a switching lever connected to said lock lever;

an inner lever connected to an inner open handle on the door;

a motor-operated actuator for switching the lock lever between the locked state and the unlocked state;

a first projection provided to the inner lever to rotate the rotating member when the inner lever is turned, regardless of whether the lock lever is in the unlocked state or the locked state; and a second projection provided to the inner lever for engagement with a projection on said switching lever, to return the lock lever and the actuator to the unlocked state only when they are in the locked state.

2. An automotive door locking apparatus as set forth in claim 1, wherein the output shaft of the actuator is secured with a switching lever which in turn is formed with a connecting portion connected to the lock lever and with a projection to engage with the second projection of the inner lever.

* * * * *